US007377205B2

(12) United States Patent
Rosenthal

(10) Patent No.: US 7,377,205 B2
(45) Date of Patent: May 27, 2008

(54) REVERSE THRUST SYSTEM WITH INTEGRAL CONDUITS AND NOZZLES FOR THE REDUCTION OF MUZZLE JUMP AND/OR RECOIL IN FIREARMS AND WEAPONS

(76) Inventor: Herbert Rosenthal, 7129 Promenade Dr., #801A, Boca Raton, FL (US) 33433

( * ) Notice: Subject to any disclaimer, the term of this patent is extended or adjusted under 35 U.S.C. 154(b) by 0 days.

(21) Appl. No.: 10/874,514

(22) Filed: Jun. 23, 2004

(65) Prior Publication Data

US 2005/0066803 A1 Mar. 31, 2005

Related U.S. Application Data

(63) Continuation of application No. 10/353,541, filed on Jan. 29, 2003, now Pat. No. 6,769,346, which is a continuation of application No. 10/010,701, filed on Nov. 8, 2001, now abandoned.

(51) Int. Cl.
*F41A 21/36* (2006.01)

(52) U.S. Cl. ..... 89/14.3

(58) Field of Classification Search ..... 89/14.3
See application file for complete search history.

(56) References Cited

U.S. PATENT DOCUMENTS 785,973 A 3/1905 McClean
1,415,919 A 5/1922 Butler et al.
2,662,326 A 12/1953 Powell
3,665,804 A * 5/1972 Rohr ..... 89/14.3
3,769,731 A 11/1973 Pachmayr et al.
3,808,943 A 5/1974 Kelly
4,207,799 A 6/1980 Tocco
4,392,413 A 7/1983 Gwinn, Jr.
5,243,895 A 9/1993 Dickman et al.
5,476,028 A 12/1995 Seberger
5,587,549 A 12/1996 Clouse
5,872,323 A 2/1999 Norton et al.

(Continued)

*Primary Examiner*—Stephen M Johnson
(74) *Attorney, Agent, or Firm*—Malin Haley DiMaggio; Bowen & Lhota, P.A.

(57) ABSTRACT

A projectile firing gun or weapon barrel is adapted with a gas porting system having conduits and outlets specifically configured, positioned and adapted for maximizing reductions in muzzle jump and/or recoil in accordance with principles of reverse thrust. The conduits or flow tubes are contemplated to be configured to function as nozzles whereby varying the shape and size of the conduit walls can maximize the outlet velocity of gases flowing at subsonic as well as supersonic velocities and the stream of redirected gas flow can be concentrated. The system incorporates porting holes located further rearward than at the barrel muzzle, but at a proven safe distance from the barrel chamber, which porting holes are in fluid communication with gas conduits/nozzles. Such conduit/nozzle openings redirect in a specific upwardly direction and concentrate a vented stream of high velocity expanding gas generated upon firing of the gun or weapon so as to maximize the generation of downward thrust forces to overcome muzzle jump. Similarly, such conduit/nozzle openings redirect rearward and concentrate a vented stream of high velocity expanding gas generated upon firing of the gun or weapon so as to maximize the generation of forward thrust forces to overcome felt recoil. Venting the explosion gases further rearward than at the barrel muzzle maximizes the duration of thrust forces as gases are vented well prior to the projectile exiting the barrel and utilizes gas forces greater than that available after the projectile has exited the barrel.

7 Claims, 6 Drawing Sheets

U.S. PATENT DOCUMENTS 6,216,578 B1 4/2001 Ledys et al.
6,269,727 B1 8/2001 Nigge
6,276,251 B1 8/2001 Downing et al.

* cited by examiner

REVERSE THRUST SYSTEM WITH INTEGRAL CONDUITS AND NOZZLES FOR THE REDUCTION OF MUZZLE JUMP AND/OR RECOIL IN FIREARMS AND WEAPONS

CROSS REFERENCE TO RELATED APPLICATIONS

This application is a continuation of U.S. patent application Ser. No. 10/353,541, filed on Jan. 29, 2003, now U.S. Pat. No. 6,769,346, which is a continuation of U.S. patent application Ser. No. 10/010,701, filed on Nov. 8, 2002, now abandoned.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all rights whatsoever including copyrights.

BACKGROUND OF THE INVENTION

1. Field of the Invention

The present invention relates to firearms and weapons, and, more particularly to the more complete employment of, recognition of and conformity with the principles of reverse thrust in conjunction with the nozzle effect, both as applicable to subsonic and/or supersonic gas flow, so as to produce greater momentum of said gasses in order to generate more significant forces for use in the reduction of muzzle jump and/or recoil of firearms and weapons upon firing.

2. Description of the Background Art

The firing of projectiles, bullets, shot, and shells (hereinafter "projectile") from firearms and weapons is an advancement that is well known in the art. The act of firing such firearms and weapons is known to result in recoil and muzzle jump, the reduction of either or both of which is the subject of the present invention. Recoil is the result of rearward acting force acting upon the weapon, and upon the shooter, during the firing process, which recoil is created by the forward momentum of the projectile. Muzzle jump is an upward movement of the barrel upon firing. Muzzle jump results from the recoil force acting along the longitudinal axis of the barrel, which axis is typically above the point of resistance supporting the weapon. For example, a shoulder-fired weapon, such as a rifle, shotgun or submachine gun, has a point of resistance—other than the resistance presented by the weight of the weapon itself—where the butt of the weapon rests against the shooter's shoulder. The highest point on the butt of the weapon, namely the heel, is typically one or more inches below the axis of the barrel, and hence below the level at which the recoil force acts. The spacing between the heel and the uppermost exterior portion of the barrel, including what is referred to as the rib, is a term of art referred to as the amount of drop at the heel. As a result of the drop at the heel, the recoil force vector acts above the point of resistance thereby resulting in a moment force that causes the barrel to pivot upward. Similarly, in the case of a hand-held weapon such as a pistol, the uppermost portion of the grip or the main bearing portion of the hand upon the rear of the grip is below the level of the barrel. Since the barrel axis represents the recoil force vector, muzzle jump is also experienced with handguns.

Recoil and muzzle jump are undesirable for a number of reasons. For example, in anticipation of recoil and muzzle jump shooters have been known to flinch, resulting in an uncontrollable momentary closing of the eye, which flinching is a cause of poor aim and missed targets. Furthermore, physically resisting muzzle jump and recoil tends to fatigue the shooter and inhibits the shooter's ability to fire a large number of projectiles, particularly in rapid succession. In addition, the reduction of muzzle jump and recoil will enable the use of larger mass projectiles. Given that the recoil force is dependent in part on the weight of the firearm (e.g. the heavier the firearm, the lower the resulting recoil experienced by the shooter, and visa versa), and that the use of lighter weight firearms is more desirable for military and police use, as well as any other uses that require one to carry the firearm for long periods of time, recoil reduction increases the shooter's ability to tolerate the firing of larger mass projectiles, than otherwise and/or to use a lighter firearm that otherwise. In addition, since recoil and muzzle jump each cause the firearm to move out of alignment with the target, follow-up shots at the target are more difficult and the ability of the shooter to rapidly and accurately return the firearm to a properly aimed position is greatly hindered. Accordingly, the reduction of muzzle jump and/or recoil enhances the shooter's ability to rapidly and accurately return the firearm to a properly aimed position.

In the case of submachine guns the successive, incremental muzzle jumps caused by rapid automatic fire results in muzzle "Climb" which raises the firearm out of alignment with the intended target during firing. Current methods to overcome "Climb" include, but are not limited to, the reduction of the cyclic rate of fire (e.g. from 800 or 650 rounds per minute to 440 rounds per minute) and use of pre-selected three, four or five round firing burst limiters. While such methods tend to curb, but not eliminate, the aggregate amount of "Climb" per firing burst, they do so at the cost of reduction of the total number of rounds accurately deliverable to the target within a given measure of time. Consequently, "Climb" represents a dangerous impediment to lawful users of submachine guns, such as military and police (e.g. SWAT teams). The reduction of muzzle jump in submachine guns through the use of the reverse thrust system equates to the reduction of "Climb" and thus to the ability to deliver a greater total number of rounds to the target within an equal measure of time. While the location of the reverse thrust device is still intended to be located at a safe distance from the chamber of the barrel, given the significantly shorter barrels lengths commonly used in submachine guns the relative location may be closer to the muzzle.

The reduction of recoil and muzzle jump is also desirable in other applications, such as those applications involving large weapons and/or military cannons. Specifically, the reduction of recoil shock forces will improve the viability of electronic and mechanical systems and equipment in military hardware such as tanks and ships. The reduction of recoil shock will also benefit the physical and mental well being of personnel in proximity to the firing station associated with large weapons. Finally, the reduction of recoil will result in less fatigue and shock stress for metals and other components of the weapon and firing stations, thereby improving durability.

While the background art reveals several attempts directed to reducing muzzle jump and recoil, it does not reveal a system for reducing muzzle jump and/or recoil that recognizes or applies the greater benefits available through observance of and conformity with, or material conformity with, the applicable principles of reverse thrust. Moreover, while the background may include the use of conduits for directing gas flow it does not also contemplate the conduits to function as nozzles or to function as nozzles in compliance with the goal of maximization of the principles of reverse thrust.

For example, it is known to provide porting for shotgun and firearm barrels to reduce recoil and muzzle jump. The porting of the barrel enables the venting of gases in a generally upward direction during the firing process. Such gasses thus escaping on a wide cone, unconcentrated flow basis are subject to immediate and broad expansion directly diminishing the opposing force that the gas flow was intended to create for the purpose of reducing muzzle jump and/or recoil. The venting of gases in this manner is extremely inefficient, and thus incomparable, in that it generates only minimal downward forces on the barrel to stabilize the muzzle and reduce muzzle jump. Such systems fail to harness and thus maximize the otherwise available reverse thrust forces. The inherent inefficiency of a number of systems is only slightly offset by venting barrel gases at or near the muzzle end of the barrel, at which location a certain minimal advantage due to increased leverage applicable to muzzle jump is possible. For example, U.S. Pat. No. 3,808,943, issued to Kelly, discloses a gun-leveling device that comprises a barrel having trapezoidal slots for venting muzzle gases to prevent muzzle jump. U.S. Pat. No. 4,207,799, issued to Tocco, discloses a muzzle brake for attachment to a handgun for venting gas in a generally upwardly direction to assist in maintaining the firearm stable. U.S. Pat. No. 4,392,413, issued to Gwinn, Jr., discloses a muzzle attachment for a firearm barrel. The muzzle attachment is configured to act as both a muzzle brake to reduce recoil and as a compensator to reduce upward movement of the muzzle when the firearm is fired. U.S. Pat. No. 5,243,895, issued to Dickman et al., discloses a gun barrel defining trapezoidal ports positioned on radials between fifteen and twenty-five degrees from the upper centerline of the barrel to prevent muzzle jump. U.S. Pat. No. 5,587,549, issued to Clouse, discloses a barrel porting system comprising a barrel adapted to define a pair of rows of spaced apart venting orifices extending through the barrel to vent exhaust gases. The venting orifices are configured to vent gases both upwardly and rearwardly, so that resultant vector forces generated by the escaping gases are translated into downwardly and forwardly directed components to reduce muzzle jump and recoil. U.S. Pat. No. 6,269,727, issued to Nigge, discloses a muzzle-mounted attachment that deflects combustion gases after leaving the barrel. As noted hereinabove, each of the above-referenced patents disclose systems for venting gases at or near the muzzle end of the barrel.

Furthermore, U.S. Pat. No. 3,665,804, issued to Rohr, discloses a pistol adapted with barrel openings leading to elongated gas transfer passageways extending parallel to and disposed on either side of the barrel which passageways terminate in gas escape ports. The gas escape ports are configured to extend upwardly and to either side at an acute angle to vertical such that the escaping gas tends to force the open end of the barrel downwardly upon firing. By configuring mere escape ports in the angled configuration disclosed, Rohr fails to take full advantage of reverse thrust potential generated by the escaping gas thereby significantly reducing the opposing force directed to moving the barrel downward. Rohr also fails to disclose nozzles for concentrating the escaping gases to maximize reverse thrust or to control supersonic or subsonic gas flow. Furthermore, Rohr teaches positioning of the barrel openings immediately forward of the cartridge chamber thereby dangerously diminishing the structural integrity of the weapon at a point of extreme internal pressure. Also, recoil reduction can only be accomplished by a rearward, not forward, directed gas flow so as to generate a forward thrust to overcome the rearward recoil force.

U.S. Pat. No. 4,374,484, issued to Bekker et al., discloses a lift compensator adapted for rotatable adjustment on the flash hider of a gun barrel for redirecting gases discharged from the flash hider to compensate for muzzle lift. By locating the device outside of and at the forward end of the barrel, the device deals primarily with expanding and dissipating gasses exiting the barrel as opposed to gasses under concentrated pressure and thus the relative effectiveness of recoil reduction and reduction of muzzle jump is substantially reduced. Also, due to inertia, once the projectile exits the barrel the gas remaining in the barrel will tend to exit through the center of the Bekker device rather than through the Bekker ports. The device disclosed by Bekker et al., further fails to disclose integrated nozzle effects or concentration of redirected gas flow for maximizing reverse thrust.

U.S. Pat. No. 4,930,397, issued to Seidler, discloses a device for reducing recoil in small arms by incorporating deflector surfaces for upwardly deflecting gases generated during the firing of a projectile, and thus also fails to utilize the principles of reverse thrust. The deflector surfaces disclosed by Seidler merely allow the escaping gases to disperse and thus also fail to maximize reverse thrust potential by failing to concentrate and redirect the gases in a compact and/or concentrated stream and at a specific angle or vector best suited to produce reverse thrust forces for the intended purposes. Again, the device deals primarily with expanding gasses exiting the barrel as opposed to gasses under concentrated pressure and thus the relative effectiveness of recoil reduction and reduction of muzzle jump is substantially reduced.

While the background art reveals a number of attempts directed to reducing muzzle jump and recoil, there remain a number of significant shortcomings with apparatus and methods disclosed. The primary disadvantage present in the art is a virtually complete failure to utilize principles of reverse thrust to create and direct streams of concentrated gas flow so as to maximize and harness counteracting forces for their intended use.

A further significant shortcoming involves the effectiveness of muzzle gas venting structures positioned near the muzzle end of the barrel and angularly disposed relative to the upper centerline of the gun barrel. Specifically, the angled vent configuration is less effective at reducing muzzle jump since only a portion of the thrust force generated by the escaping gas is directed in the full vertical direction.

Finally, the venting ports disclosed in the background art tend to be located near the muzzle end of the barrel. Accordingly, the effective venting of muzzle gas commences after the projectile has exited the barrel thereby delaying the onset of counteracting forces generated by the escaping gas.

In addition, none of the attempts disclose a structure that directs a sufficiency of muzzle gas momentum in a rearward direction as is required for counteracting recoil forces.

These and other disadvantages present in the art provide opportunities for substantial improvements and innovation. Thus, there exists a need for improvements in the field of firearms and weapons to reduce muzzle jump and recoil that overcomes the problems and disadvantages present in the background art.

BRIEF SUMMARY OF THE INVENTION

The present invention provides a system to make the most of the employment of and conformity with the principles of reverse thrust in conjunction with the nozzle effect, both as applicable to subsonic and/or supersonic gas flow, so as to produce greater momentum of said gasses in order to generate more significant forces for use in the reduction of muzzle jump and/or recoil of firearms and weapons upon firing.

Concentrated streams of gas, generating greater reverse thrust forces than widely dispersed streams, are directed upward (to reduce muzzle jump) and/or rearward (to reduce recoil). More particularly the present invention provides for adaptation of a projectile firing gun or weapon barrel with a gas porting system having conduits conformed to function as nozzles and specifically configured and positioned for maximizing reverse thrust forces. The system disclosed herein also avoids the aforementioned limitations and disadvantages present in the art by incorporating porting holes located further rearward from the muzzle end of the barrel, but at a proven safe distance from the barrel chamber, than systems disclosed by the prior art, which porting holes are in fluid communication with gas conduits conformed to serve as nozzles for harnessing and directing maximum reverse thrust forces. The principles of reverse thrust are harnessed by redirecting and concentrating streams of explosion gases in a substantially upward direction to maximize the downward thrust force used to counteract muzzle jump. Venting concentrated streams of explosion gases from a location further rearward from the muzzle end of the barrel maximizes the duration of thrust forces. The porting conduits are to be configured as nozzles so as to maximize and/or control the gas stream velocity and to redirect and concentrate the escaping gas stream along a vector that will maximize forces so created to counter muzzle jump and/or recoil. The integral conduit/nozzles maximize the velocity and concentration of the gas stream in a smaller cone and in a preferred direction or axis, thereby maximizing the thrust forces applied to counteract muzzle jump (when directed upward) and/or recoil (when directed rearward).

In a preferred embodiment, a conventional cylindrical gun barrel is adapted with a generally U-shaped body defining a cylindrically concave mid-portion sized for receiving a gun barrel in mating engagement therewith. The gun barrel is adapted to define a pair of left and right side gas venting ports that communicate with generally L-shaped or rounded gas conduits defined in the U-shaped body, which are also to serve as nozzles via modification of their shape, such as converging or diverging, and/or size to address supersonic and subsonic gas flow considerations and its related momentum and forces in accordance with the applicable laws of physics and the principles of reverse thrust and conservation of momentum. Each conduit/nozzle includes an inlet in communication with a corresponding barrel port, and an outlet configured for directing the gases in an upward direction thereby creating a downward force to counter muzzle jump. By attaching the U-shaped body further rearward from the muzzle end of the barrel (i.e. open end from which the projectile exits the barrel) forces are generated earlier and for longer periods, than with systems disclosed in the background art, to counteract muzzle jump and/or recoil. By positioning the U-shaped body forward of the projectile chamber excessive pressure is avoided and concentrated gas streams are vented shortly after firing. The conduit/nozzles provide for the diverting or re-directing of a concentrated, high velocity gas stream that results in higher momentum and reverse thrust forces than the barrel vent holes disclosed in the art.

Accordingly, it is an object of the present invention to provide a system and method for reducing muzzle jump and recoil in firearms and weapons by maximizing use of the principles of reverse thrust.

Another object of the present invention is to provide an improved projectile firing barrel wherein muzzle jump is reduced utilizing reverse thrust by redirecting a concentrated flow of gases and in a substantially vertical direction.

Yet another object of the present invention is to provide a system for reducing recoil utilizing reverse thrust by redirecting a concentrated flow of gases in a rearward direction.

Still another object of the present invention is to provide an improved gun or weapon barrel adapted to reduce muzzle jump and/or recoil utilizing reverse thrust by routing explosion gases through a conduit flow tube serving as a nozzle.

Another object of the present invention is to provide a system for reducing muzzle jump and/or recoil by tapping the barrel further rearward from the muzzle end of the weapon to utilize and vent gases in closer proximity to firing, for the purposes here intended, than venting systems heretofore known in the art.

Still another object of the present invention is to provide a system for reducing muzzle jump and/or recoil that requires fewer venting holes than systems disclosed in the background art.

Another object of the present invention is to provide a barrel adapted to reduce muzzle jump and/or recoil that is easier to clean and maintain due to fewer venting ports acting to accumulate firing residue.

Yet another object of the present invention is to provide a system for reducing muzzle jump and/or recoil that is structured and positioned along the barrel so as to be concealable by the fore-end and thus not to substantially protrude and/or substantially alter the lines of the firearm or weapon.

A further object of the present invention is to provide a system for reducing muzzle jump and/or recoil that does not cause the act of firing to be excessively noisy as is so in weapons having numerous porting holes and which porting holes allow gasses to escape on a rapidly expanding and non-concentrated stream basis.

Still these and other objects will be disclosed and/or become apparent in view of the detailed description and drawings.

DETAILED DESCRIPTION OF THE INVENTION

Figure 1:
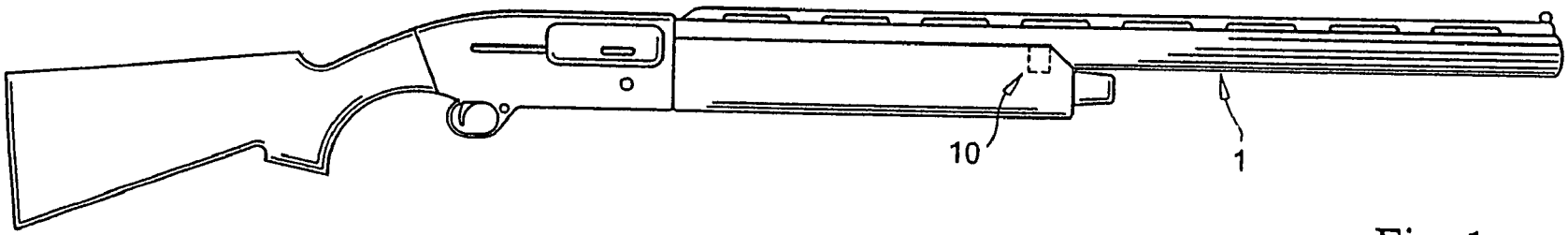
FIG. 1 is a perspective view of a shotgun having a barrel adapted in accordance with the present invention.
Figure 2:
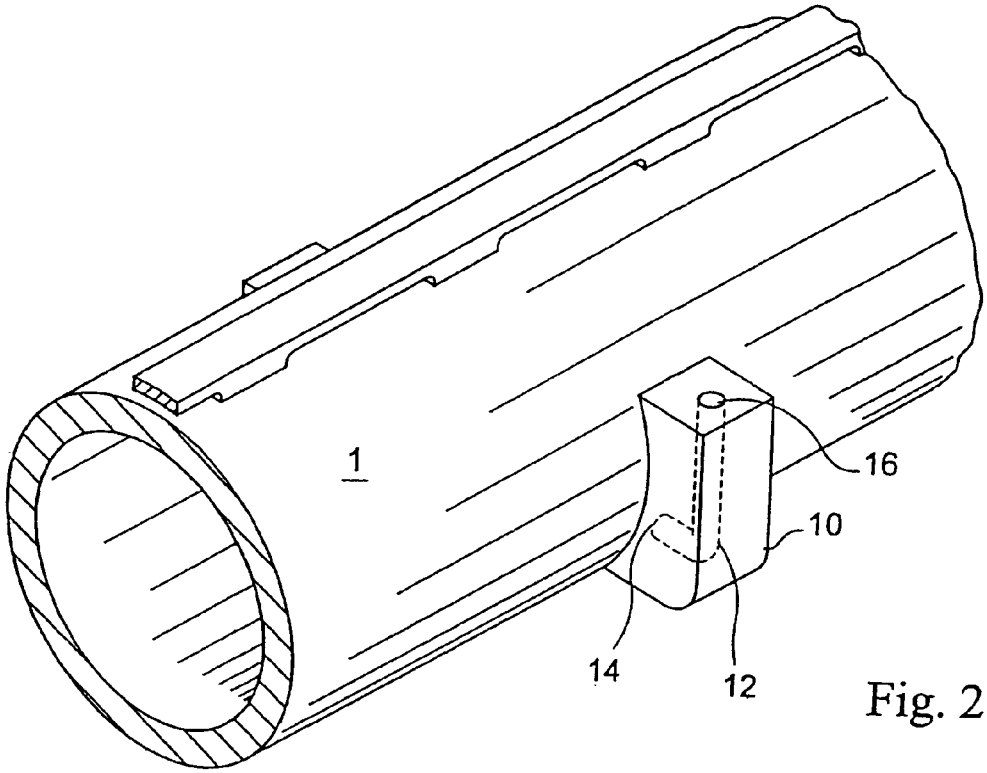
FIG. 2 is a partial perspective view thereof.
Figure 3:
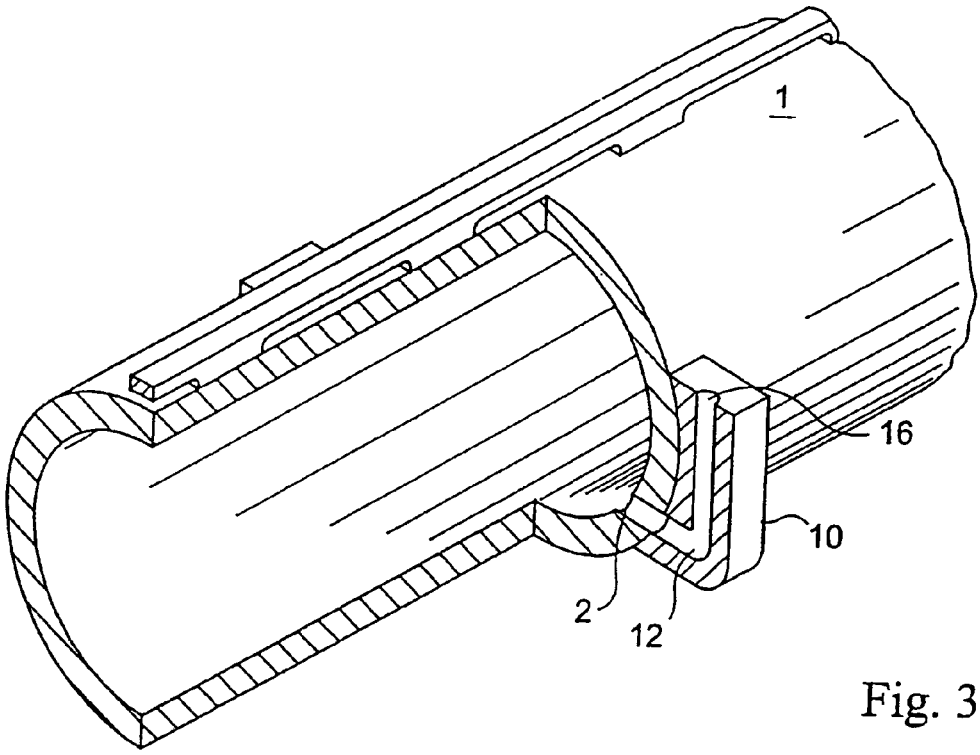
FIG. 3 is a partial sectional view of FIG. 2.
Figure 4:
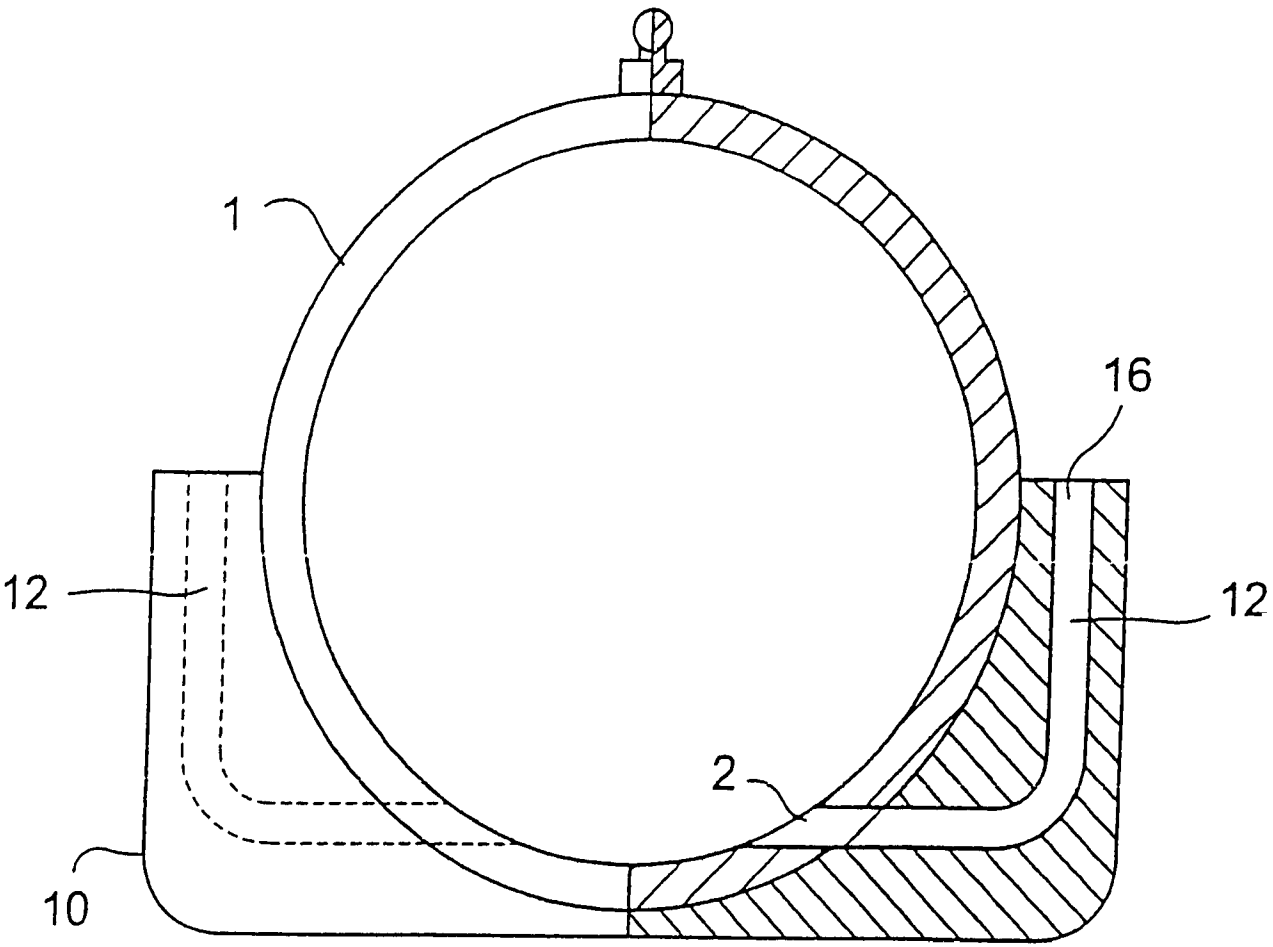
FIG. 4 is a front view thereof in partial section.

With reference now to the drawings there is depicted an improved porting system for firearm and weapon barrels according to the present invention. As best seen in FIGS. 1-4, a preferred embodiment of the present invention includes adapting the barrel of a projectile firing gun or weapon, referenced as 1, with a gas flow redirection and concentration system including a barrel attachment body, generally referenced as 10 disposed approximately midway between the barrel ends. In a preferred embodiment, barrel 1 is adapted so as to define vent ports 2 formed by through holes machined in the barrel wall. Barrel attachment 10 is preferably a solid rigid body and defines a pair of gas conduits/nozzles, referenced as 12. Conduits/nozzles 12 each include an inlet 14 in mating relation with a barrel vent port 2, and outlets or nozzles 16 preferably aligned and vertically disposed relative to the normal, horizontal firing position of the barrel so as to project concentrated explosion gases directly upward thereby maximizing downward reverse thrust forces to reduce muzzle jump.

Attachment body 10 is preferably located further from the muzzle end of the firearm or weapon than systems heretofore known in the art, as best depicted in FIG. 1, so as to initiate the venting of gases sooner after the firing of the weapon or firearm. As should be apparent, conduit inlets 14 are sized and positioned for mating engagement with the outer surface of barrel 1, and particularly so as to be in fluid communication with barrel ports 2 in a manner that forms a pressure resistant seal between the outer surface of the barrel and the engaging surface of body 10. Attachment body 10 may be fabricated from heat resistant carbon fiber, stainless steel, or any other suitable gunmetal or material. Ports 2 are preferably formed in the lower portion of the barrel since such a configuration is structurally and functionally proven and reliable.

The explosion associated with the firing of a weapon generates expanding gases and results in very high pressure within the barrel, which pressure is greater prior to the projectile exiting the barrel. After the projectile exits the barrel the pressure therein rapidly equalizes with atmospheric pressure. The present invention overcomes a number of disadvantages present in the art by locating the porting holes closer toward the receiver end of the barrel but at a proven safe distance from the chamber of the barrel so as to take advantage of the high-pressure gases therein and commencing well prior to the projectile exiting the barrel. Accordingly, high-pressure gases are vented from the interior of barrel through vent ports 2, conduits/flow tubes 12, and outlets or nozzles 16 whereby the pressurized gas is redirected in a concentrated upward direction at a high velocity. The concentrated, high velocity upwardly directed gas flow stream momentum thus produces a downward reverse thrust force that counteracts the tendency of the muzzle to move upward (e.g. muzzle jump). Since conduits 12 and particularly outlets 16 results in redirecting the concentrated, high velocity gas flow stream momentum vertically and perpendicular to the barrel axis the downward force is maximized.

Figure 5:
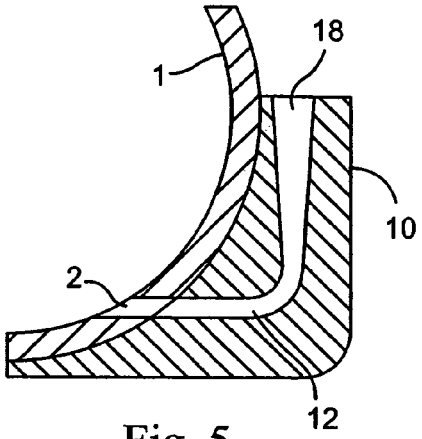
FIG. 5 is a front partial view of an alternate embodiment having an outlet defined by a diverging wall.
Figure 6:
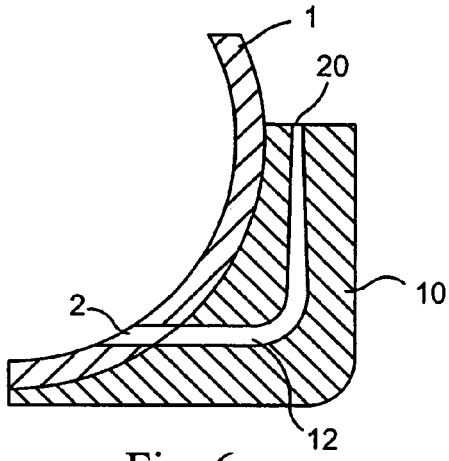
FIG. 6 is a front partial view of an alternate embodiment having an outlet defined by a converging wall.

In an alternate embodiment depicted in FIG. 5, alternate conduit/nozzles 18 are defined by a diverging wall to form a nozzle for supersonic flow. In such embodiments, the diverging nozzle functions to maximize the velocity of the escaping gas in accordance with principles of fluid dynamics for supersonic flow. In yet another alternate embodiment depicted in FIG. 6, alternate conduit/nozzles 20 are defined by a converging wall to form a nozzle to maximize the velocity of escaping gas in accordance with the principles of subsonic flow. The conduit wall may be formed so as to converge over a substantial portion of the conduit length so as to produce a more directed gas stream and one having a smaller cone that is less susceptible to early expansion and the resultant loss of momentum and thrust forces. In such embodiments, the nozzle outlet functions to increase the velocity of the escaping gas in accordance with principles of fluid dynamics thereby maximizing reverse thrust forces.

Figure 7:
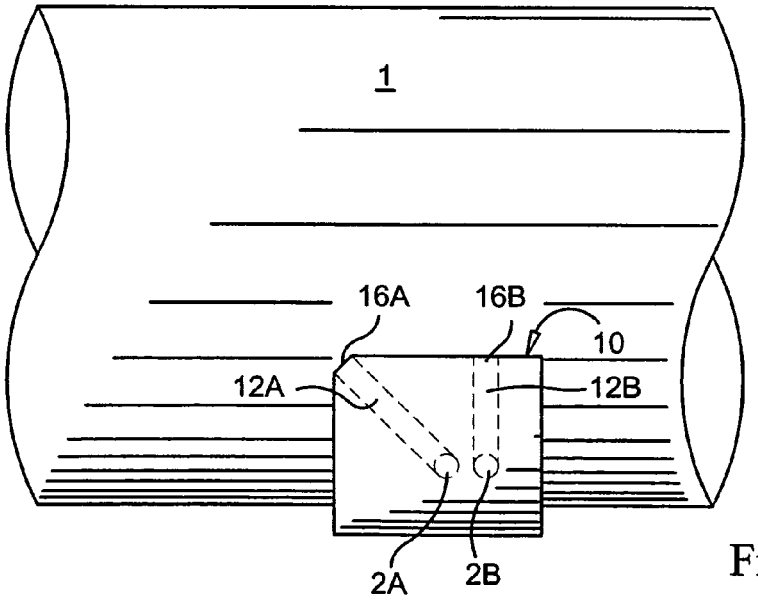
FIG. 7 is a partial side view of an alternate embodiment having multiple conduits, one set being configured vertical to reduce muzzle jump and the other set being configured approximately 45-degree rearward to reduce felt recoil but to a lesser extent than if directed fully rearward and to reduce muzzle jump but to a lesser extent than if directed fully upward.
Figure 8:
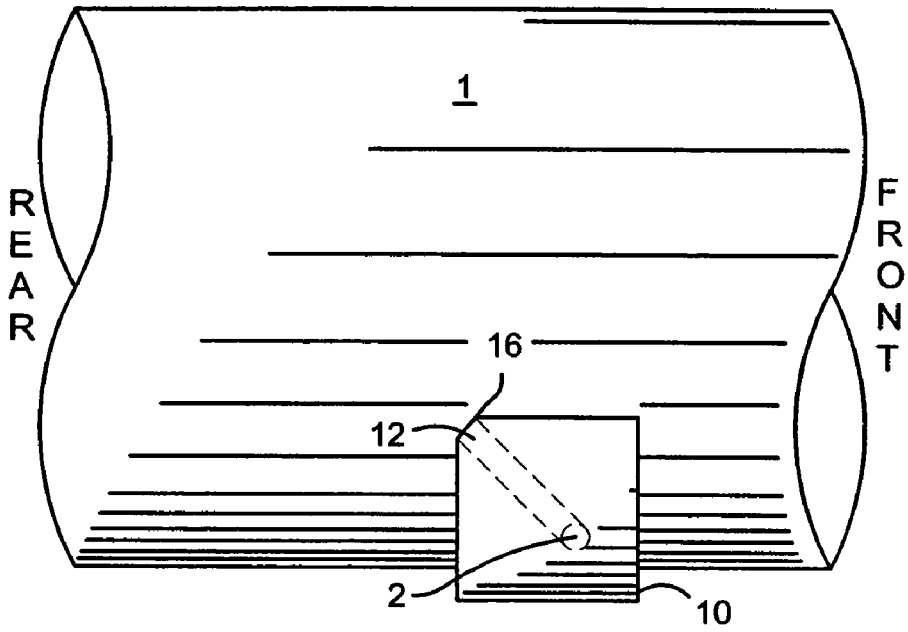
FIG. 8 is a partial side view of a shotgun barrel adapted with an approximately 45-degree rearward and upward conduit attachment for reducing felt recoil but to a lesser extent than if directed fully rearward and to reduce muzzle jump but to a lesser extent than if directed fully upward.
Figure 9:
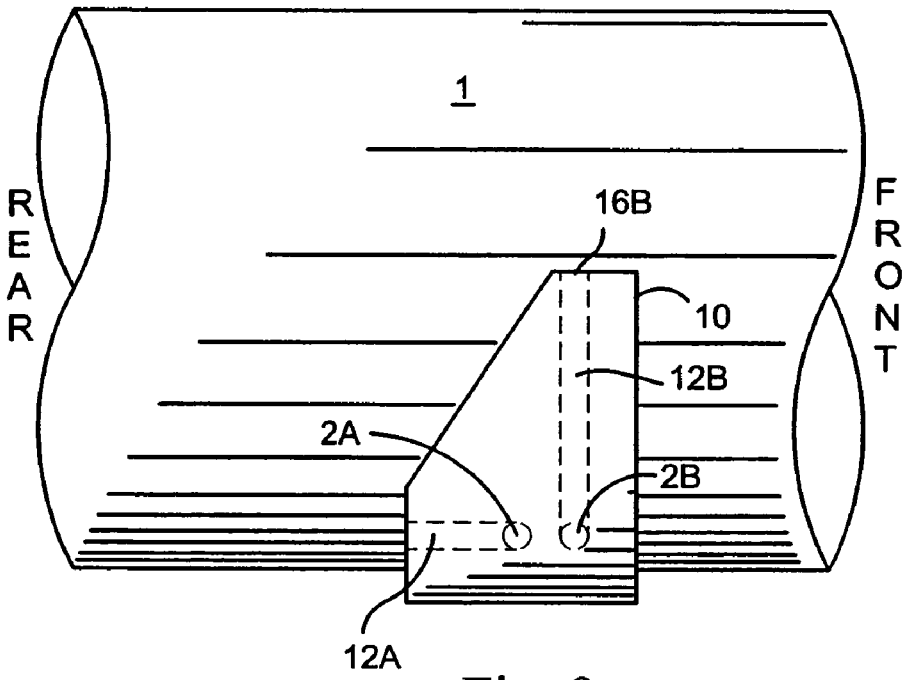
FIG. 9 is a partial side view of a semi-automatic shotgun barrel adapted with a multiple conduit attachment for reducing muzzle jump and supplying gas to the gas piston.

Further alternate embodiments are depicted in FIGS. 7-9. With reference to FIG. 7 there is depicted a multiple conduit/nozzle embodiment wherein the left and right sides of body 10 each define first and second conduits/nozzles 12A and 12B. Conduits/nozzles 12A and 12B each communicate with corresponding barrel vent ports 2A and 2B for venting and redirecting gases through conduit/nozzle outlets 16A and 16B. In this embodiment, conduit/nozzle 12B is configured vertically upward to divert concentrated gas upward to counteract muzzle jump, and conduit/nozzle 12A is configured at an upward angle so as to divert concentrated gas both upward and rearward to counteract both muzzle jump and recoil. This allows for either a larger combined downward force or, to the extent that one set of the two conduits is slanted more rearward as depicted in FIG. 7, the generation of a greater forward force to reduce recoil. In the alternate embodiment depicted in FIG. 8 (a partial view) a shotgun barrel is adapted in accordance with the present invention with conduits at such an angle to reduce both muzzle jump and recoil by diverting concentrated gas both upward and rearward. As should be apparent, any variation of the conduit configurations disclosed herein, and various modifications thereof which result in reduction of muzzle jump and/or recoil are considered within the scope of the present invention. With reference to FIG. 7, attachment body 10 includes first and second gas flow conduits/nozzles, referenced as 12A and 12B. Conduit/nozzle 12B is configured to redirect concentrated gas, upon firing, in a substantially vertical direction to produce a reverse thrust force for reducing muzzle jump. Conduit/nozzle 12A is angled upward and rearward (e.g. toward the shooter), preferably at an angle of approximately 45 degrees to redirect concentrated gas, upon firing, upward and rearward to produce a thrust force that has a first thrust force component for reducing muzzle jump and a second thrust force component for reducing recoil.

FIG. 9 depicts another alternate embodiment for use with semi-automatic shotguns. In the embodiment depicted in FIG. 9 attachment body 10 includes first and second flow conduits/nozzles, referenced as 12A and 12B. Conduits/nozzles 12B is configured to redirect concentrated gas, upon firing, in a substantially vertical direction to produce a thrust force for reducing muzzle jump. Conduit 12A is configured to route gas to the gas cylinder of the gas operated semi-automatic loading and firing mechanism housed within the weapon. The embodiment depicted in FIG. 9 is mechanically efficient and reliable as compared with alternate systems in the art. Thus, a portion of the gas is used to operate the action and a portion used to produce thrust for reducing muzzle jump. The conduit/nozzle dedicated to reducing muzzle jump can also act to safely divert excess gas above that needed to operate the action.

Figure 10:
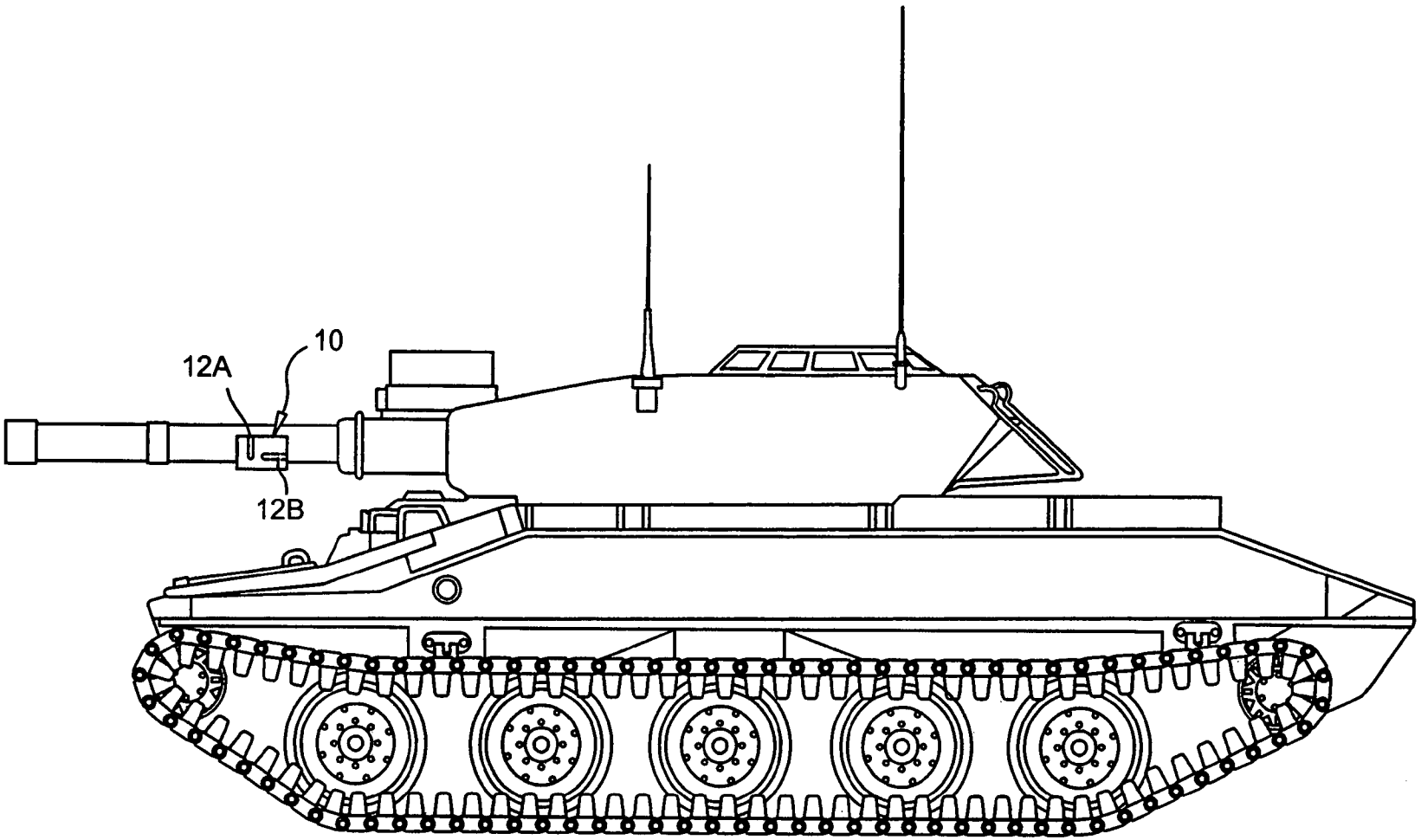
FIG. 10 is a side view of an alternate embodiment adapted for use with a military tank cannon, it being noted that there is no comparable safety restriction on the fully rearward redirection of gas flow for the reduction of recoil as may apply in the case of a weapon held by the hands and on the shoulder of shooter.

FIG. 10 depicts an adaptation of a military weapon barrel, namely, a tank cannon barrel in accordance with the present invention. As depicted in FIG. 10, the cannon barrel is adapted with an attachment body 10. Attachment body 10 includes first and second flow conduits/nozzles, referenced as 12A and 12B. Conduits/nozzles 12A is configured to redirect concentrated gas, upon firing, in a substantially vertical direction to produce a thrust force for reducing muzzle jump. Conduits/nozzles 12B is configured to redirect concentrated gas, upon firing, in a substantially horizontal rearward direction to reduce recoil. In this, and other military embodiments wherein personnel are shielded and or otherwise protected (e.g. ship mounted guns), concentrated gas may be vented horizontally rearward as shown in FIG. 10 to maximize recoil reducing reverse thrust forces.

The present invention further contemplates modifying and/or varying the conduit/nozzle diameter to maximize the outlet velocity of gases flowing at subsonic as well as supersonic velocities. For example, in the case of subsonic flow a narrowing of the conduit/nozzle diameter results in an increase in flow velocity. In contrast, however, in the case of supersonic flow an increasing cross section will accelerate the flow.

In addition, the attachment body of the present invention eliminates the need for a bulky attachment or protuberance affixed to the front of the barrel. By adapting the barrel with vent ports and an attachment body located at a more rearward location, the structural alterations may be more fully concealed by the fore-end of the weapon.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A system for reducing the effects of muzzle jump in a firearm or weapon having a barrel having a first end in communication with a firing chamber and an open second end, said barrel defined by a generally cylindrical barrel wall in surrounding relation with an axis through which a projectile travels under the influence of expanding gases generated by explosive material upon firing, said system comprising:

a body attached to said barrel approximately midway between said barrel first and second ends, said body defining internal opposing left and right side conduits, said left conduit having an inlet in communication with a through bore defined on the left side of said barrel wall, said right conduit having an inlet in communication with a through bore defined on the right side of said barrel wall, each of said conduits having an outlet oriented so as to direct a concentrated stream of gas in a generally vertical upward direction perpendicular to the direction of the barrel axis when said barrel axis is horizontally disposed.

2. A system for reducing muzzle jump of a firearm or weapon according to claim 1, wherein said conduits include diverging conduit walls.

3. A system for reducing muzzle jump of a firearm or weapon according to claim 1, wherein said means for concentrating the stream of gas includes converging conduit walls.

4. A system for reducing the effects of muzzle jump in a firearm or weapon having a barrel defined by a generally cylindrical barrel wall in surrounding relation with an axis through which a projectile travels under the influence of expanding gases generated by explosive material upon firing, said system comprising:

a body attached to said barrel, said body defining internal opposing left and right side conduits, each conduit defined by a generally cylindrical wall, and each conduit having a length exceeding its diameter with any angular bends being characterized as a radius bend, said left conduit having an inlet in communication with a through bore defined on the left side of said barrel wall, said right conduit having an inlet in communication with a through bore defined on the right side of said barrel wall;

each of said conduits falling generally within a plane disposed perpendicular to a longitudinal axis of said barrel, each of said conduits having an outlet oriented so as to direct a concentrated stream of gas in a generally vertical upward direction, perpendicular to the direction of the barrel axis when said barrel axis is horizontally disposed, said conduits and said outlets functioning to discharge concentrated streams of gas perpendicular to said barrel axis.

5. A system for reducing muzzle jump of a firearm or weapon according to claim 4, wherein said conduits include a diverging conduit wall.

6. A system for reducing muzzle jump of a firearm or weapon according to claim 4, wherein said means for concentrating the stream of gas includes a converging conduit wall.

7. A system for reducing muzzle jump of a firearm or weapon according to claim 4, wherein said conduits include a generally cylindrical conduit wall.

* * * * *